United States Patent [19]

Mestre Mas

[11] Patent Number: 4,774,820

[45] Date of Patent: Oct. 4, 1988

[54] FLAT KNITTING MACHINE

[75] Inventor: Matias Mestre Mas, Andorra, Spain

[73] Assignee: H. Stoll GmbH & Co., Reutlingen, Fed. Rep. of Germany

[21] Appl. No.: 130,474

[22] Filed: Dec. 9, 1987

[30] Foreign Application Priority Data

Dec. 12, 1986 [ES] Spain ..... 8603380
May 4, 1987 [ES] Spain ..... 8701315

[51] Int. Cl.[4] ..... D04B 15/88
[52] U.S. Cl. ..... 66/149 R
[58] Field of Search ..... 66/149, 150, 152

[56] References Cited

U.S. PATENT DOCUMENTS 3,760,609 9/1973 Poocza et al. ..... 66/152
4,359,881 11/1982 Basoggio et al. ..... 66/149 R

FOREIGN PATENT DOCUMENTS 518538 2/1931 Fed. Rep. of Germany ..... 66/152
45-5052 2/1970 Japan ..... 66/150
59-168156 9/1984 Japan ..... 66/152
2100761 1/1983 United Kingdom ..... 66/150

*Primary Examiner*—Ronald Feldbaum
*Attorney, Agent, or Firm*—Larson and Taylor

[57] ABSTRACT

A flat knitting machine with a take-down system comprising a rotatable take-down roller and a counter-pressure member, between which the knitted fabric produced is clamped to draw it down during the production of the fabric, is improved in such a way that the take-down system functions faultlessly with fabrics which gradually increase in width as well as with fabrics which involve a rapid and considerable increase in the number of needles. This is achieved in that underneath and between the needle beds is arranged a longitudinally extending plate which is pivotable to and fro, has a length corresponding to that of the needle beds, and is provided with a blunt upper edge, over which is laid at least one endless take-down belt, which is tensioned between the upper edge of the plate and a drive roller located further beneath the needle beds, wherein the plate is urged in such a way that the blunt upper edge, over which the endless belt is laid, acts as a gripping clamp, which presses the knitted fabric against the needle bed, and thus prevents the fabric running back.

4 Claims, 5 Drawing Sheets

Figure 1:
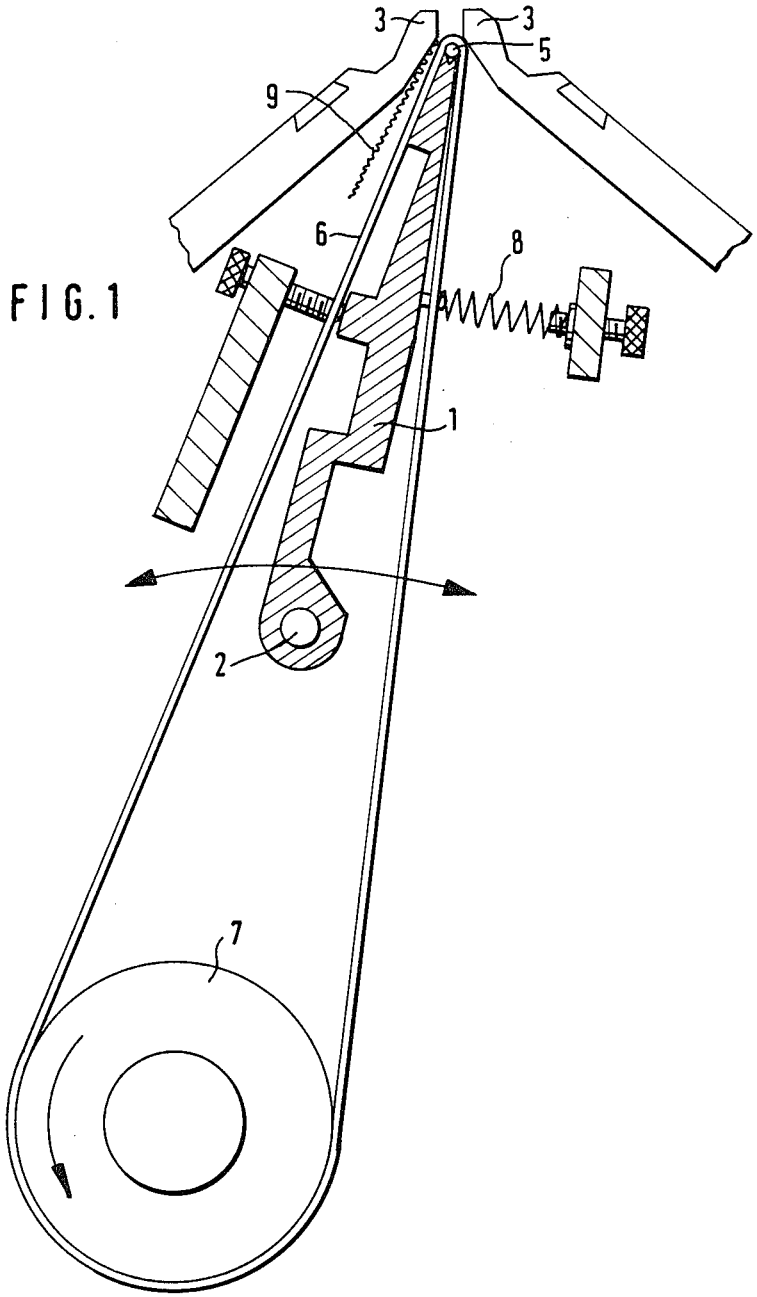

FIG. 4
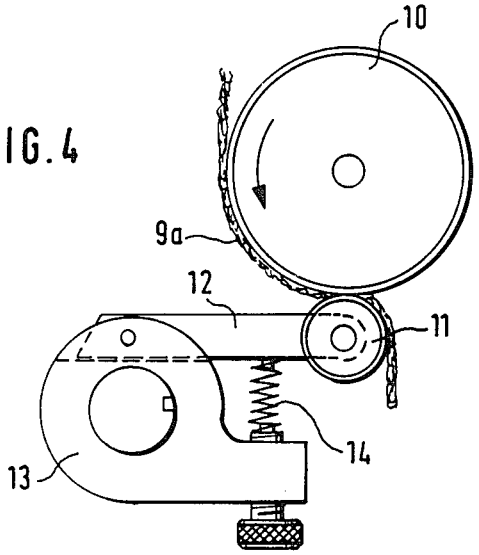
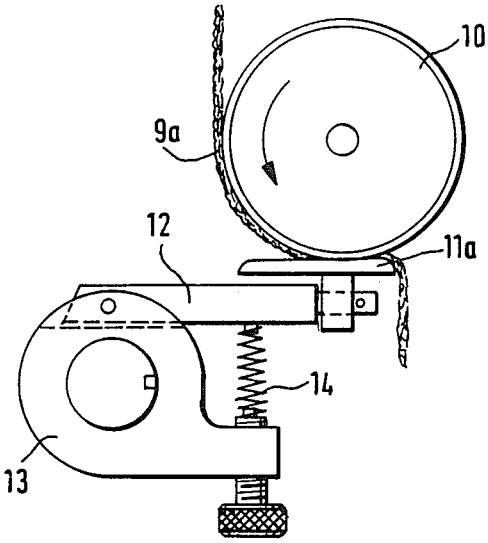
FIG. 5

FIG.8
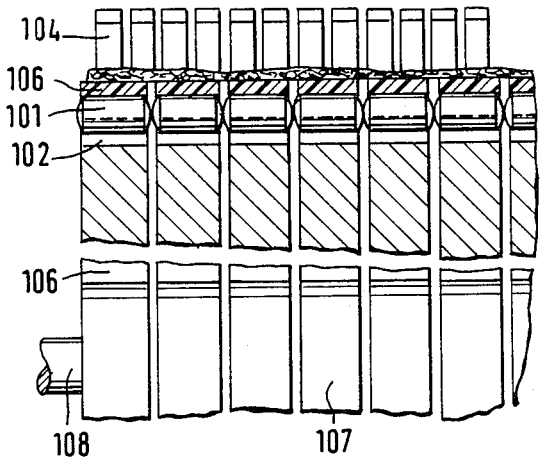
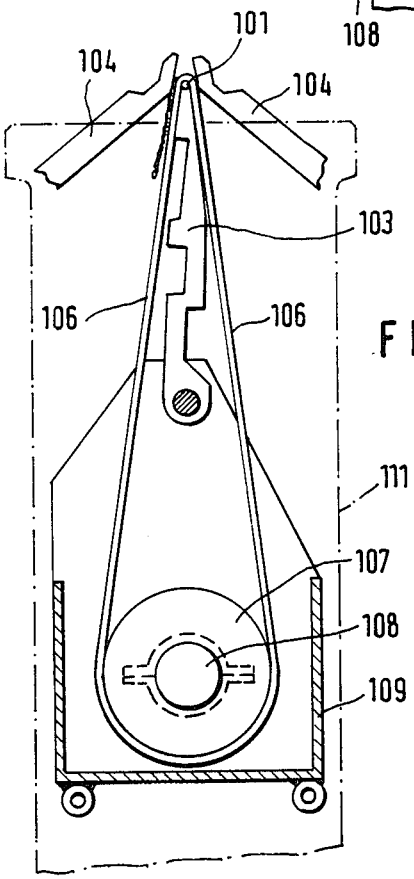
FIG.9

FLAT KNITTING MACHINE

DESCRIPTION

The invention relates to a flat knitting machine with a take-down system comprising a rotatable take-down roller and a counter-pressure member between which the knitted fabric produced is clamped in order to draw it down during the production of the fabric.

The conventional take-down systems of flat knitting machines operate satisfactorily if the fabric produced has a constant width and, as a result, the number of needles remains constant. Such systems are, however, less effective if the fabric has a slowly increasing width. Whilst, where the fabric has a rapid increase in fabric width, that is, where an equally rapid increase in the number of needles is brought about, the take-down systems hitherto known are completely ineffective.

This problem has been recognised for a long time. It is essentially to be attributed to the fact that the conventional take-down systems lie too far away from the region in which the stitches are formed. This has the consequence that between the stitch forming region and the take-down region there lies a considerable length of fabric, which allows the fabric to run back, especially when the width of the fabric alters.

The conventional take-down systems include a take-down roller over which the knitted fabric is laid and towards which there is resiliently urged by spring force either a second take-down roller tangential to the first and of smaller diameter, or a blunt strip. These take-down systems have the disadvantage that, as a consequence of their particular construction, they are mounted too far from the operating plane of the needles.

As is known, flat knitting machines have a cam carriage movable to and fro from one end of the machine to the other so that the stitch formation is always begun alternately at one end of the machine or the other. As the cam carriage moves across the needle beds, there is, as a result, always one end of the fabric which has more stitches than the other end, and this situation alternates between the ends. The difference between the numbers of stitches at the two ends of the fabric is greater, the greater the number of knitting systems with which the cam carriage is provided.

The difference in the numbers of stitches is not a problem in machines with a conventional take-down mechanism. The situation is different, however, if the take-down device acts against the rear side of one of the needle beds.

The reason for this is to be seen in that the conventional take-down devices act at a considerable distance from the stitch-forming region and in that between the latter region and the region in which the take-down device engages the fabric a considerable number of courses is present. For this reason, the difference in the number of stitches is compensated for by the knitted fabric itself, which is in fact elastic, and it is not necessary to adjust the operating region of the take-down device in dependence upon the position of the cam carriage.

With take-down systems which act against the rear side of a needle bed, the fabric can no longer compensate for the difference in the numbers of stitches, since the take-down device acts directly beneath the freshly produced course of stitches over its whole length, so that one can quite clearly establish a difference between the end of the fabric with the freshly produced courses and the other end of the fabric without stitches between the take-down system and the region of stitch formation.

Another disadvantage observed in machines with this kind of take-down system emerges during the production of designs which require a patterning device, as is the case with designs with yarns in cable or plaited formation. Since in these cases the take-down device is mounted very high in the machine, there is added to the lateral tension, which the needles must exert to shift the fabric during the operation of the patterning device, the pressure which is exerted by the take-down device on the knitted fabric and through the latter on the rear side of the needle bed, which serves as an opposing member. The resulting problems are practically insoluble.

The object of the present invention is therefore to improve a flat knitting machine of the kind set out in the introduction in such a way that the take-down system functions faultlessly with fabrics which increase slowly in width as well as with fabrics which involve a rapid and considerable increase in the number of needles.

The object is achieved according to the invention by means of the features set out in the characterising part of claim 1.

The improvements developed for the solution of the problem set out above have a number of advantages in that one can extend the effectiveness of the take-down device to every kind of knitting irrespective of whether it involves changes in width or not, and also with respect to the simplification of the construction.

These improvements consist essentially in that a longitudinally extending plate is mounted underneath and between the needle beds for pivotable to and fro movement, has a length corresponding to the length of the needle beds, and is provided with a blunt upper edge, over which an endless take-down belt is laid, which is tensioned between the upper edge of the plate and a drive roller located further beneath the needle beds. The plate is resiliently urged against the rear side of one of the needle beds so that the blunt upper edge over which the endless take-down belt is laid acts as a gripping clamp, which presses the knitted fabric against the needle bed and thus prevents the fabric from running back.

According to an advantageous embodiment the upper edge of the movable plate is formed as a mounting for a take-down roller extending in the longitudinal direction, whose width is dimensioned to correspond with the width of the needle beds. The upper surface of this roller projecting out of the upper edge of the plate is covered by the endless take-down belt, which is tensioned between the take-down roller and the drive roller lying further beneath the needle beds, so that the take-down belt acts as a gripping clamp in the region of the take-down roller and presses the fabric lying between it and the rear side of one of the needle beds against the latter.

According to a further possible embodiment of the device according to the invention, several coaxial take-down rollers rotatable independently of one another are mounted in a groove in the upper edge of the to-and-fro pivotable plate, and each take-down roller is actuated by its own endless take-down belt, which is tensioned between the take-down roller and its own drive roller. The drive rollers are driven successively as the stitch formation progresses, in dependence upon the tension in the knitted fabric and are stopped once more as soon as the fabric is tensioned.

In addition, it is envisaged that the entire take-down system is mounted in a movable housing, which is displaceable parallel to and synchronously with the needle bed by the pattern control device or a duplicate of that.

Further features, advantages and possible applications of the invention are to be found in the following description of embodiments, which are shown in the drawing. Therein, all the features described and/or shown pictorially constitute individually or in a desired combination the subject matter of the invention irrespective of their summary in the claims or their respective relationship.

Figure 2:
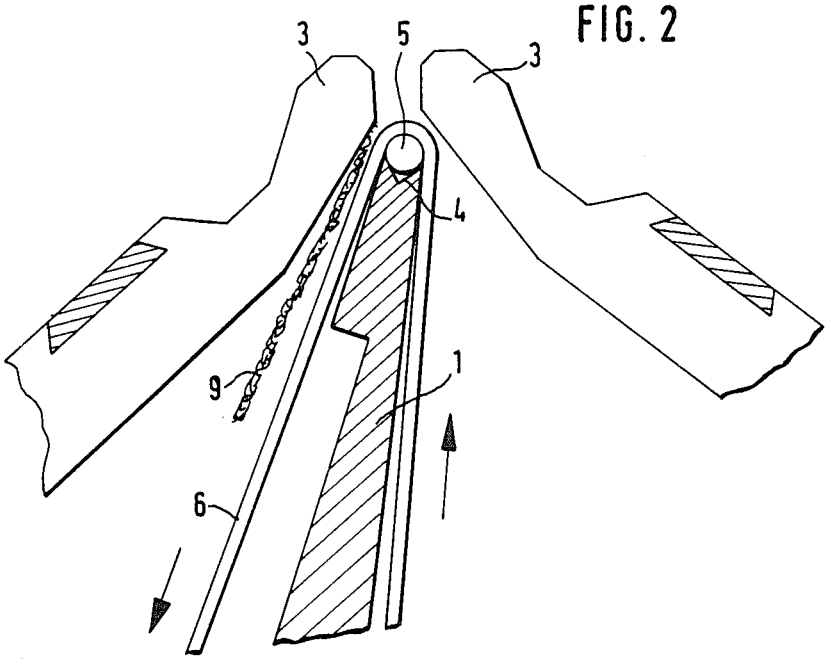
Figure 3:
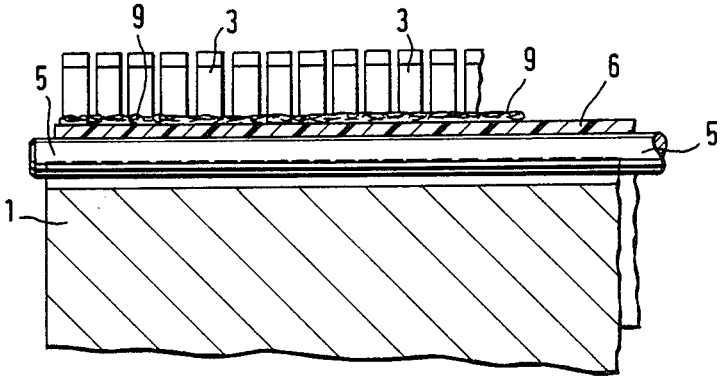
Figure 6:
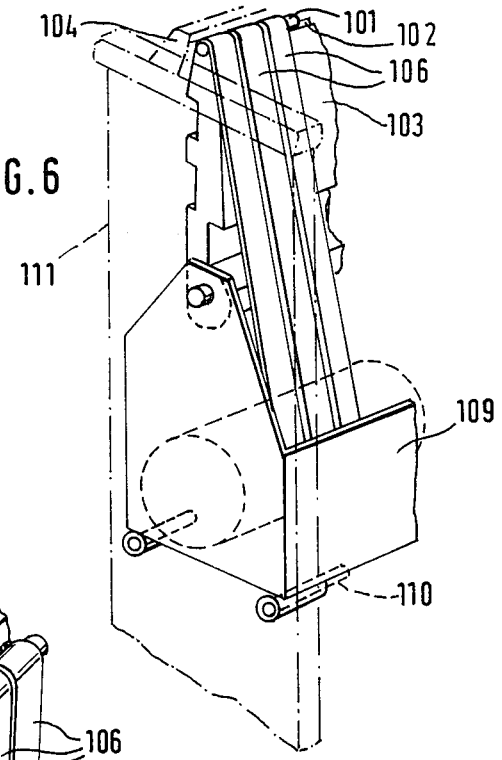
Figure 7:
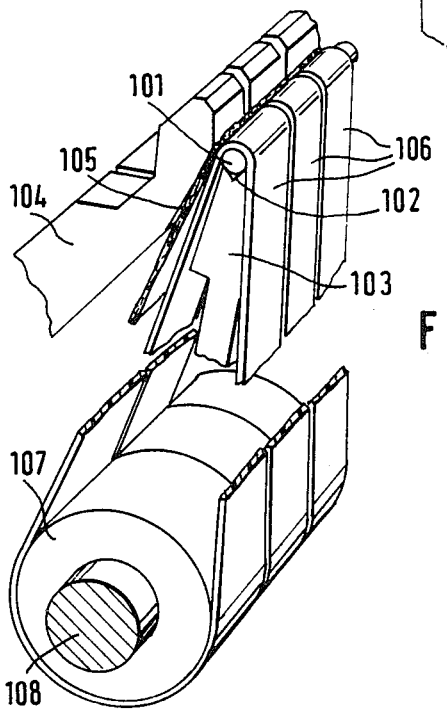

There is shown in:

FIG. 1 in schematic representation a side view of the needle beds of a flat knitting machine according to the invention, FIG. 2 on an enlarged scale, a detail from FIG. 1 in the region of the needle beds, FIG. 3 a detail in the operating region of the take-down roller, which with the endless take-down belt and the fabric to be taken down is supported against the needle bed, FIG. 4 a side view of a known take-down device, which operates with a combination of take-down rollers lying tangentially to one another, one of which is resiliently urged against the other and wherein the fabric is gripped between the two take-down rollers, FIG. 5 a side view corresponding to FIG. 4 of another known take-down device comprising a plate, which is resiliently urged against a take-down roller, wherein the fabric is gripped between the take-down roller and the plate, FIG. 6 a perspective view of a take-down system according to the invention, FIG. 7 in partly sectioned representation an enlarged perspective representation of a detail of the take-down device, FIG. 8 in partly sectioned representation a front view of a further detail of the take-down device according to the invention, and FIG. 9 a side view of the take-down device according to FIG. 6.

The take-down system for flat knitting machines shown in FIGS. 1 to 5 comprises a movable plate 1, which is pivotable to and fro about an axle 2 located underneath the needle beds 3. The plate 1 is provided at its upper edge with at least one groove 4 extending along the whole length of the edge. In this groove is located a rotatable take-down roller or a rotatable take-down 5, which is located at the same height as the needle heads of the needle beds 3.

The take-down 5 is operated by means of an endless take-down belt 6, which is tensioned between the take-down roller 5 and a drive roller 7 located underneath the needle beds 3.

The movable plate 1 is resiliently acted on by a spring 8 or another device suitable to exert a resilient force. It is thus achieved that the rotatable take-down roller 5, which is located in the groove 4 and the region of which projecting out of the groove 4 is covered by the endless belt 6, is urged against the rear side of the needle bed 3 together with the take-down belt, so that it acts in conjunction with the rear side of the needle bed as a take-down device, which prevents the knitted fabric running back.

The fabric 9 coming from the stitch-forming region is pressed by and drawn down by the take-down belt 6 over the whole width in the region in which the take-down belt is supported on the take-down roller 5, so that—which is still more important—the pressure is applied in a region which lies very close to the stitch-forming region, in fact against the rear side of the needle bed of the machine. In this way the knitted fabric 9 which is produced is prevented from running back even with a rapid increase in the number of needles and consequently in the width of the fabric.

As can be seen from FIGS. 4 and 5, which show two typical embodiments of known take-down devices, these devices include a take-down roller 10, which is contacted by a second take-down roller 11 (FIG. 4). The latter is mounted on a support arm 12, which is articulated on a bracket 13 and resiliently acted upon by a spring 14. The knitted fabric 9*a* is drawn down between the two take-down rollers 10 and 11. In the embodiment according to FIG. 5, the counter pressure roller 11 is replaced by a bar 11*a*, which fulfills the same function as the take-down roller 11.

If one compares these known embodiments with the device according to the invention, the differences and advantages of the embodiment according to the invention compared with the known embodiments are very clearly established. These differences consist first in the mounting position for the take-down device, which in the case of the older embodiments lie well spaced from the region of stitch formation, because, due to the support 12, 13 it is completely impossible to mount the device close to the region of stitch formation. The improvements described, on the other hand, make possible the mounting of the pressure roller at the same height as the rear side of the needle beds of the machine, one of which exercises the same function as one of the take-down rollers, 10, 11 of the known devices. This mounting position for the take-down device in the immediate neighbourhood of the region of stitch formation has the effect that the fabric no longer runs back even with rapid alterations in the width of the fabric.

A further difference between the known embodiments and the device according to the invention consists in that the former has a bracket 13, which can be dispensed with in the device according to the invention.

The take-down device according to the invention provides, as a result, in addition to the above mentioned advantages of a practical kind related to efficiency of operation, economic advantages, since it simplifies the construction and mounting of the take-down device.

The form, dimensions and materials of the component parts of the device can naturally depart from the representations. It is envisaged that the upper side of the plate 1 can have one or more grooves for the reception of one or more take-down rollers 5. Further, the details with respect to the mounting position for the drive roller 7 do not touch upon the essential features of the present invention.

According to the embodiment of FIGS. 6 to 9, the take-down device comprises a number of coaxial, independently rotatable take-down rollers 101, which are located in a groove 102 in the upper edge of a movable plate 103, which is resiliently urged against the needle bed 104 and acts as a gripping clamp for drawing down the fabric 105.

Each take-down roller 101 is driven by an endless take-down belt 106 which is tensioned between the take-down roller 101 and a drive roller 107, and the endless take-down belt lies directly against the fabric 105 and presses this against the needle bed 104.

The driver rollers 107 are operated successively in dependence upon the tension in the fabric 105. Whilst the cam carriage moves forward and forms new courses of stitches, the tension in the fabric falls and the drive rollers 107 are set in motion. As soon as the fabric is again under tension, they are halted once more. Thus there is achieved a manner of operating in synchronism with the movement of the cam carriage whether from left to right or the reverse. A practical way of achieving this synchronised movement of the drive rollers can consist in mounting the drive rollers on a common, continuously rotating axle 108, which carries the take-down rollers 101 with it in succession in dependence upon the tension in the fabric in the counter-pressure region of the corresponding take-down belt 106, an operation made possible with the help of a coupling or free-wheel located between each take-down roller and the rotating axle 108.

The take-down device described is mounted in a housing 109, which is movable on rails 110 secured on the machine frame 111. The housing 109 moves, together with the take-down device mounted within it, synchronously with the needle beds, by means of the pattern control device or a duplicate thereof, according requirements or the mode of operation of the machine.

As can be understood from the description and the drawing, it is possible, through the arrangement of a number of coaxial take-down rollers lying parallel to the needle bed 104, which are operated successively non-synchronously and in dependence upon the tension in the fabric, in order to draw down the latter automatically during the formation of new courses of stitches, in each case in exactly the right region of the fabric, and also to stop the fabric take-down action automatically as soon as tension is no longer required.

With respect to the mounting of the take-down device in a housing 109 which is movable synchronously with the needle bed by means of the pattern control device or a duplicate thereof, it is to be noted that the lateral load, to which the needles would other be subjected when the control device acts to produce cable or other knitting patterns, is relieved.

I claim:

1. A flat knitting machine comprising:

a take-down system comprising a rotatable take-down roller and a counter-pressure member, between which the knitted fabric produced is clamped to draw it down during production of the fabric, characterized in that underneath and between the needle beds (3,104) is arranged a longitudinally extending plate (1,103), which is pivotable to and fro, has a length corresponding to that of the needle beds, and is provided with at least one take-down roller at an upper edge, over which is laid at least one endless take-down belt (6,106), which is tensioned between the take-down roller at the upper edge of the plate (1,103) and a drive roller (7,107) located further beneath the needle beds, wherein the plate (1,103) is resiliently urged towards the near side of one needle bed (3,104) in such a way that the take-down roller at the upper edge, over which the endless take-down belt (6,106) is laid, acts as a gripping clamp, which presses the knitted fabric (9,105) against the needle bed and thus prevents the fabric from running back, and a movable housing in which the take-down system is mounted which housing is displaceable parallel to and synchronously with the needle bed (104) by a pattern control device.

2. A flat knitting machine according to claim 1, characterised in that the upper edge of the movable plate (1,103) is formed as a mounting for a take-down roller (5,101) extending in the longitudinal direction, whose width corresponds to the width of the needle beds (3,104), wherein the upper surface of this roller (5,101), extending out of the upper edge of the plate is covered by an endless take-down belt (6,106), which is tensioned between that take-down roller (5,101) and the drive roller (7,107) located further beneath the needle beds, so that the take-down belt (6,106) acts as a gripping clamp in the region of the take-down roller and the knitted fabric (9,105) lying between the take-down roller and the rear side of the one needle bed (3,104) is resiliently pressed against the latter.

3. A flat knitting machine according to claim 1, characterised in that several coaxial and independently rotatable take-down rollers (101) are mounted in a groove (102) at the upper edge of the to-and-fro pivotable plate (103), wherein each take-down roller (101) is actuated by its own endless take-down belt (106), which is tensioned between the take-down roller and its own drive roller (107), and further characterised in that the drive rollers (107) are actuated one after the other with the progress of the stitch formation in dependence upon the tension in the knitted fabric, and upon establishment of the tension in the fabric are halted again.

4. A flat knitting machine according to claim 1 and further including a frame, rails mounted on the frame beneath the needle beds, and a mounting means for movably mounting the housing to the rails.

* * * * *